US005489417A

United States Patent [19]

Watson et al.

[11] Patent Number: 5,489,417

[45] Date of Patent: Feb. 6, 1996

[54] SPRAY CAST COPPER-MANGANESE-ZIRCONIUM ALLOYS HAVING REDUCED POROSITY

[75] Inventors: William G. Watson, Cheshire; Harvey P. Cheskis, North Haven; Sankaranarayanan Ashok, West Haven, all of Conn.

[73] Assignee: Olin Corporation, New Haven, Conn.

[21] Appl. No.: 227,201

[22] Filed: Apr. 14, 1994

Related U.S. Application Data

[63] Continuation-in-part of Ser. No. 939,769, Sep. 2, 1992, abandoned.

[51] Int. Cl.[6] ..... C22C 9/05

[52] U.S. Cl. ..... 420/493; 148/424; 148/432; 148/436; 148/442; 420/480; 420/492; 420/496; 420/499; 420/587; 420/434

[58] Field of Search ..... 420/493, 434, 420/471, 478, 479, 480, 486, 489, 490, 492, 496, 499, 587; 148/432, 424, 436, 411, 433, 434, 435, 442

[56] References Cited

U.S. PATENT DOCUMENTS

| | | | |
|---|---|---|---|
| Re. 31,767 | 12/1984 | Brooks | 164/46 |
| 2,123,628 | 7/1938 | Hensel | 420/493 |
| 3,230,078 | 1/1966 | Webb et al. | 420/434 |
| 3,661,568 | 5/1972 | McLain | 420/482 |
| 3,972,712 | 8/1976 | Renschen | 148/686 |
| 4,003,715 | 4/1977 | Cascone | 420/481 |
| 4,015,948 | 4/1977 | Tsuda | 420/482 |
| 4,049,434 | 9/1977 | Sloboda et al. | 420/482 |
| 4,166,739 | 9/1979 | Brooks | 148/402 |
| 4,632,806 | 12/1986 | Morikawa et al. | 420/479 |
| 4,804,034 | 2/1989 | Leatham et al. | 164/46 |
| 4,907,639 | 3/1990 | Ashok et al. | 164/46 |
| 4,917,170 | 4/1990 | Sankaranarayanan et al. | 164/429 |
| 4,925,103 | 5/1990 | Muench et al. | 239/79 |
| 4,926,927 | 5/1990 | Watson et al. | 164/429 |
| 4,938,278 | 7/1990 | Sankaranarayanan et al. | 164/429 |
| 4,945,973 | 8/1990 | Ashok et al. | 164/429 |
| 4,960,752 | 10/1990 | Ashok et al. | 505/1 |
| 4,961,457 | 10/1990 | Watson et al. | 164/46 |
| 4,966,224 | 10/1990 | Cheskis et al. | 164/429 |
| 4,971,133 | 11/1990 | Ashok et al. | 164/46 |
| 4,977,950 | 3/1990 | Muench | 164/429 |
| 5,017,250 | 5/1991 | Ashok | 148/411 |
| 5,154,219 | 10/1992 | Watson et al. | 164/46 |

FOREIGN PATENT DOCUMENTS

| | | |
|---|---|---|
| 53-43619 | 4/1978 | Japan . |
| 2172900 | 10/1986 | United Kingdom . |

OTHER PUBLICATIONS

"Scripta Metallurgica", Introducing Scripta Materials, vol. 23, No. 12; Dec. 1989; Damping Behavior of Incramute Modified by the Addition of Erbium to Eliminate Room Temperature Aging; B. A. Ross, et al; pp. 1085–1090.

"Final Report—INCRA Project No. 205, Incramute I—Processing and Properties"; Jul. 1973; E. Ence, et al.; Olin Metals Research Labs., New Haven, Connecticut.

Hansen and Anderko, "Constitution of Binary Alloys", 1958, McGraw–Hill Book Company, Inc.; pp. 596–601 and 935–937.

J. M. Marinkovich; F. A. Mohamed; J. R. Pickens and E. J. Lavernia, entitled "The Spray Atomization and Deposition of Weldalite 049" appearing in Journal of Metals, Sep. (1989) at pages 36–41.

*Primary Examiner*—David A. Simmons
*Assistant Examiner*—Robert R. Koehler
*Attorney, Agent, or Firm*—Gregory S. Rosenblatt

[57] ABSTRACT

Spray cast copper-manganese-zirconium alloys are disclosed. In one embodiment, the alloy is spray cast in nitrogen and contains from about 1 ppm to about 20 ppm of dissolved nitrogen. In a second embodiment, the alloy contains an addition selected from the group consisting of chromium, titanium, erbium and mixtures thereof. The alloys are useful for sound damping as the combination of zirconium and the addition inhibits degradation of the specific damping capacity of the alloy.

14 Claims, 3 Drawing Sheets

SPRAY CAST COPPER-MANGANESE-ZIRCONIUM ALLOYS HAVING REDUCED POROSITY

CROSS-REFERENCE TO RELATED APPLICATIONS

This patent application is a continuation-in-part of United States patent application Ser. No. 07/939,769 (now abandoned) entitled "Spray Cast Copper Alloys With Reduced Porosity" by William G. Watson et al., filed Sep. 2, 1992. (now abandoned)

BACKGROUND OF THE INVENTION

The present invention relates to spray cast copper alloys having reduced porosity. More particularly, the alloy is combined with an addition capable of dissolving the atomization gas.

The formation of coherent metallic articles by spray casting is disclosed in U.S. Pat. Nos. RE 31,767 to Brooks and 4,804,034 to Leatham et al. both of which are incorporated herein by reference in their entireties.

Spray casting involves passing a molten metal stream through a gas atomizer in a protective atmosphere. The atomizer is supplied with a pressurized gas which atomizes the metal and provides a protective atmosphere to prevent oxidation of the droplets. The droplets are broadcast downward from the atomizer in the form of a divergent conical pattern and strike a collector. The collector is spaced sufficiently close to the atomizer so that the droplets striking the collector are in a partially solidified state. Solidification is completed following impact with the collector. The atomized droplets coalesce on impact forming a coherent structure.

One objective of spray casting is to achieve a fully dense deposit. Frequently, the density of the spray cast deposit is only about 95% of the theoretical value. One reason for the low density is porosity.

The causes of porosity in spray casting are not fully understood. One probable mechanism is that when the cast droplets accumulate on the collector, nitrogen bubbles can become trapped at the interstitial voids between droplets. The nitrogen, which is insoluble in copper, causes bubbles which prevent the flow of metal into the interstitial voids resulting in the formation of pores when the metal solidifies completely.

Pores cause a myriad of problems. In addition to reducing the density of the casting, the pores form crack initiation sites which can cause a fracture. The pores will also reduce the electrical conductivity of the spray casting.

One method of reducing porosity is disclosed in U.S. Pat. No. 5,017,250 to Ashok et al which is assigned to a common assignee and incorporated herein by reference. Ashok et al disclose adding an element to the molten stream which reacts with the atomization gas. For example, zirconium, titanium, aluminum or chromium are used when nitrogen is the atomization gas. In conformance with the above theory of porosity, the reactive elements react with nitrogen at the interstitial voids forming a solid nitride dispersoid.

Applicants have developed a different means for reducing the porosity of a spray cast copper alloy which does not result in the formation of a second phase dispersoid. Having determined that nitrogen is soluble in certain copper alloys containing manganese, sufficient manganese is added to the alloy so that nitrogen which collects at the interstitial voids is dissolved into the alloy resulting in improved coalescence of the droplets and a more dense casting.

SUMMARY OF THE INVENTION

Accordingly, it is an object of the invention to provide a spray cast copper base alloy having reduced porosity. It is a feature of the invention that at least one elemental addition is made prior to atomization. The addition is selected to be capable of dissolving the atomizing gas.

It is an advantage of the invention that a high density spray cast deposit is produced. It is another advantage of the invention that the spray cast alloys have a finer grain structure and are easier to process than conventionally cast alloys of the same composition. Yet another advantage of the invention is that when manganese is the addition, certain of the cast alloys have utility for sound damping or for shape memory applications.

In accordance with the invention, there is provided a spray cast alloy. The alloy contains an addition in an amount effective to dissolve an atomization gas. The balance of the alloy is a metal or metal base alloy.

DESCRIPTION OF THE PREFERRED EMBODIMENTS

The spray cast metal alloys of the invention are atomized by impingement of a molten alloy stream with a pressurized gas. The gas is selected to be essentially non-reactive with the alloy. A preferred gas is nitrogen due to its low cost and availability. To increase the density of the spray cast deposit, an addition comprising at least one element capable of dissolving the atomizing gas is made to the metal or metal base alloy. A preferred metal is copper. When the atomizing gas is nitrogen, a preferred addition to the copper or copper base alloy is manganese.

The amount of the addition is that effective to increase the density of the spray cast deposit. If the alloy properties are primarily the result of the presence of copper, such as electrical conductivity, then in preferred embodiments, the concentration of the addition is that effective to increase the density of the spray cast deposit without unduly reducing the desired properties of the alloy.

When the end use of the alloy can accept lower electrical conductivity and thermal conductivity than provided by dilute copper alloys, such as alloys for sound damping or for shape memory alloys, the amount of the additive is maximized. A manganese concentration in excess of about 5 weight percent and more preferably from about 10 weight percent to about 50 weight percent is preferred. A most preferred concentration is from about 35 to about 45 weight percent manganese.

Figure 1:
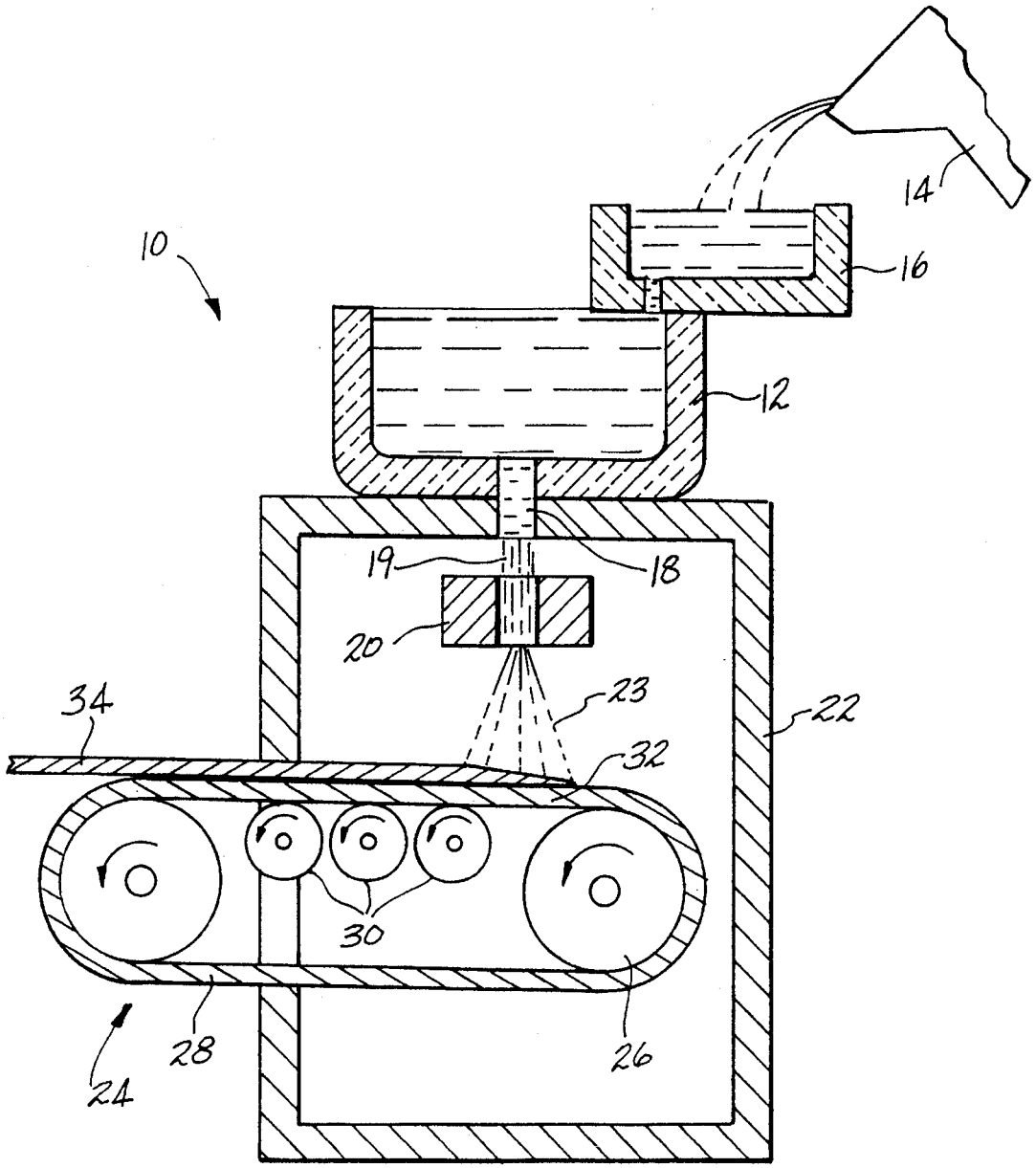
FIG. 1 shows a spray deposition apparatus for producing a continuous metallic strip in accordance with the invention.

FIG. 1 shows in cross sectional representation a spray deposition apparatus 10 for generating a continuous strip of any of the alloys of the invention. A tundish 12 receives molten metal containing the necessary alloy additions from a tiltable melt furnace 14 via a transfer lauder 16. The tundish 12 includes a bottom nozzle 18 through which the molten alloy issues in a continuous stream 19. A gas atomizer 20 is positioned below the tundish bottom nozzle 18 within a spray chamber 22. The atomizer 20 is supplied with a gas under pressure from any suitable source. The gas should preferably not react with the molten alloy and is most preferably nitrogen. The nitrogen should have a very low concentration of oxygen to avoid the formation of oxides.

The atomization gas is impinged against the molten alloy stream under pressure to produce droplets 23 having a mean particle size within a desired range. While the gas pressure will vary, typically from about 1.1 $kg/cm^2$ to about 10.5 $kg/cm^2$ (15–150 psi), dependent on the diameter of the molten stream and the diameter of the atomizing orifice, a gas to metal ratio of from about 0.10 $m^3/kg$ to about 1.0 $m^3/kg$ has been found to produce droplets having a mean diameter size of up to about 600 microns. A preferred mean particle diameter size is from about 50 to about 250 microns.

A continuous substrate system 24 extends into the spray chamber 22 in generally horizontal fashion and in spaced relation to the gas atomizer 20. The substrate system 24 includes a drive means comprising a pair of spaced rollers 26, an endless belt 28 and a series of rollers 30 which underlie and support the endless substrate 28. An area 32 of the substrate 28 directly underlies the divergent pattern of the spray. The area 32 receives a deposit of the atomized metal particles to form the metal strip product 34.

The endless substrate 28 is formed from any suitable material. To maximize the density of the spray cast metal strip product 34, excessive cooling at the area 32 is minimized by forming the endless substrate 28 from a poor thermal conductor such as a ceramic or an aluminosilicate. The endless substrate 28 may be overlaid with a metallic strip (not shown) such as stainless steel to facilitate removal of the metal strip product 34. This type of collecting system is disclosed in more detail in U.S. Pat. Nos. 4,917,170 to Ashok et al and 5,154,219 to Watson et al.

The droplets 23 striking the endless substrate 28 are preferably in a partially solidified state so that solidification occurs shortly after impact. A spray cast alloy having a composition approximately equal to that of the molten stream is formed from a vast multitude of individual droplets. The droplets coalesce to form a coherent metal strip or plate product 34 which can be removed from the endless substrate 28 for subsequent stamping or otherwise forming into desired parts.

Figure 2:
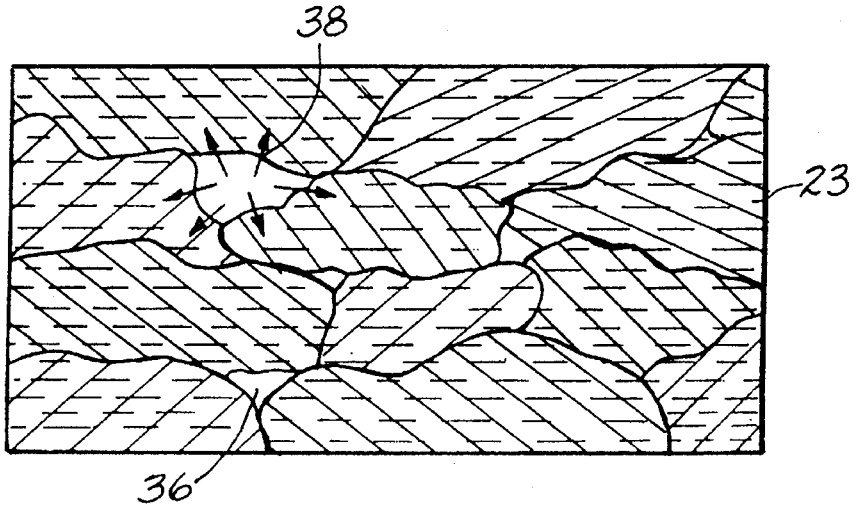
FIG. 2 shows in cross sectional representation an exploded view of the solidification of spray cast droplets on a collector.

FIG. 2 shows in cross sectional representation the mechanism by which porosity is believed to be reduced by the alloys of the invention. FIG. 2 shows an exploded view of the region "A" of FIG. 1. The spray cast droplets 23 are accumulated on a collector (not shown). The droplets are partially solidified and contain both a solid and a liquid component. Disposed between droplets 23 are interstitial voids 36. The interstitial voids 36 are filled with nitrogen. The nitrogen gas does not react with conventional copper alloys and the gas is not absorbed by those alloy. As a result, the flow of liquid metal from the droplets 23 into the voids is prevented. When solidification of the droplets is complete, a pore is formed.

However, when the droplets 23 comprise the copper manganese alloys of the invention, the nitrogen within the interstitial voids 36 is not trapped, rather, the gas is dissolved into the alloy as indicated by reference arrows 38. The dissolution of the gas creates a vacuum in the interstitial voids encouraging the flow of liquid metal from the droplets to fill the void. Porosity is thereby reduced or eliminated.

The interstitial voids usually occupy from about 1% to about 10% by volume of the spray cast deposit. When the nitrogen filling these voids is dissolved into the copper alloy, the nitrogen content of the alloy is from about 1 ppm to about 20 ppm by weight. In preferred embodiments, the copper alloy contains from about 5 ppm to about 15 ppm nitrogen.

Figure 3:
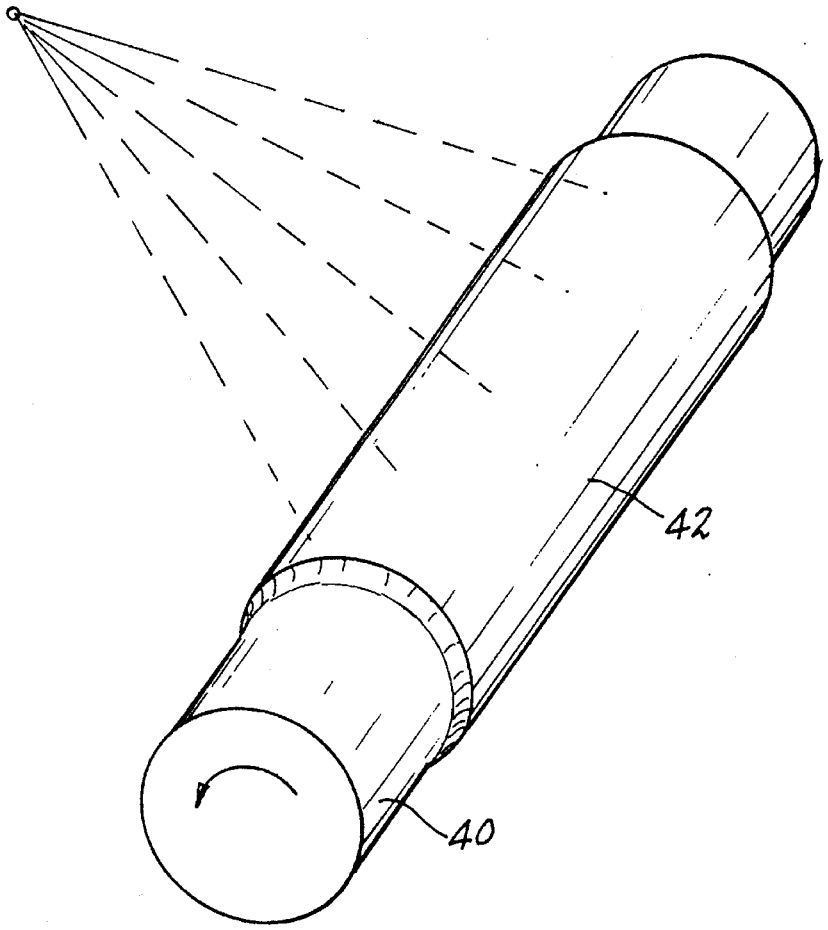
FIG. 3 shows a collector for producing a metallic tube in accordance with the invention.

In a second embodiment of the invention, the spray droplets 23 are collected on a rotating cylindrical collector 40 as illustrated in FIG. 3. The atomizing apparatus is not illustrated, but would be similar to the apparatus 10 illustrated in FIG. 1. With the collector 40, a spray cast tube 42 is formed.

The tube 42 is particularly useful when manufactured from a sound damping alloy containing copper and manganese such as the alloy sold under the trademark "INCRAMUTE". The alloy has the composition (in weight percent):

| | |
|---|---|
| 52–60 | copper |
| 39.0–45.0 | manganese |
| 1.0–2.8 | aluminum |
| up to 0.20 | cobalt, iron, and zinc |
| up to 0.10 | silicon and tin |
| up to 0.05 | carbon and phosphorus. |

As disclosed in a publication by Ross et al appearing in the December 1989 issue of SCRIPTA METALLURGICA, it is desirable to add an effective amount of a second addition to inhibit room temperature aging of the INCRAMUTE. One such second addition is erbium in an amount of from about 0.05 to about 0.30 weight percent and preferably from about 0.10 to about 0.25 weight percent. Another second addition, which inhibits degradation of the specific damping capacity better than erbium is zirconium. The zirconium is provided in an amount of from about 0.05 to about 0.50 weight percent and preferably in an amount of from about 0.25 to about 0.45 weight percent.

Also suitable are combinations of zirconium and erbium with the combination second addition being present in an amount of from about 0.10 to about 0.60 weight percent and preferably the combination is present in an amount of from about 0.40 to about 0.60 weight percent.

Other second additions which are believed to impart similar benefits are titanium and chromium.

INCRAMUTE is particularly useful in naval and automotive applications where sound damping of a fluid traveling within the tube is desired. The fine grain structure and absence of second phase inclusions resulting from spray casting of the alloy should improve the damping capability of the alloy as well as improve the corrosion resistance.

While the specification has been drawn to improving the density of spray cast copper base alloys, other alloy systems could also be improved by the addition of an atomizing gas absorber as disclosed herein. For example, another sound damping alloy is sold under the trademark "SONOSTON" (nominal composition by weight 55% Mn, 37% Cu, 4% Al, 3% Fe, 1% Ni). The manganese based alloy should also yield a dense spray cast product.

The advantages of the alloys claimed in the invention will become more apparent from the Examples which follow which are intended to be illustrative, but not limiting.

EXAMPLE 1

Essentially pure copper was spray cast as was copper containing 5 weight percent manganese and 45 weight percent manganese. As illustrated in Table 1, increasing the manganese concentration yielded a density closer to the theoretical value.

TABLE 1

| Weight percent Manganese | Percent Theoretical Density |
|---|---|
| 0 | 95 |
| 5 | 98 |
| 45 | 100 |

EXAMPLE 2

Alloy strips were formed by spray casting. The compositions are as noted in Table 2. The specific damping capacity (SDC) of each strip, the ratio of the energy lost to the maximum vibrational energy stored per cycle per unit volume, was measured. The alloy strips were aged for 2 hours at 400° C. and stored at room temperature. The SDC was measured after various amounts of storage time.

TABLE 2

| | Sample Composition (weight percent) | | | |
|---|---|---|---|---|
| Copper | Manganese | Aluminum | Zirconium | Erbium |
| balance | 41.65 | 1.99 | -0- | -0- |
| balance | 40.30 | 2.45 | 0.31 | -0- |
| balance | 42.09 | 2.51 | -0- | 0.11 |
| balance | 41.84 | 2.51 | 0.38 | 0.22 |

Figure 4:
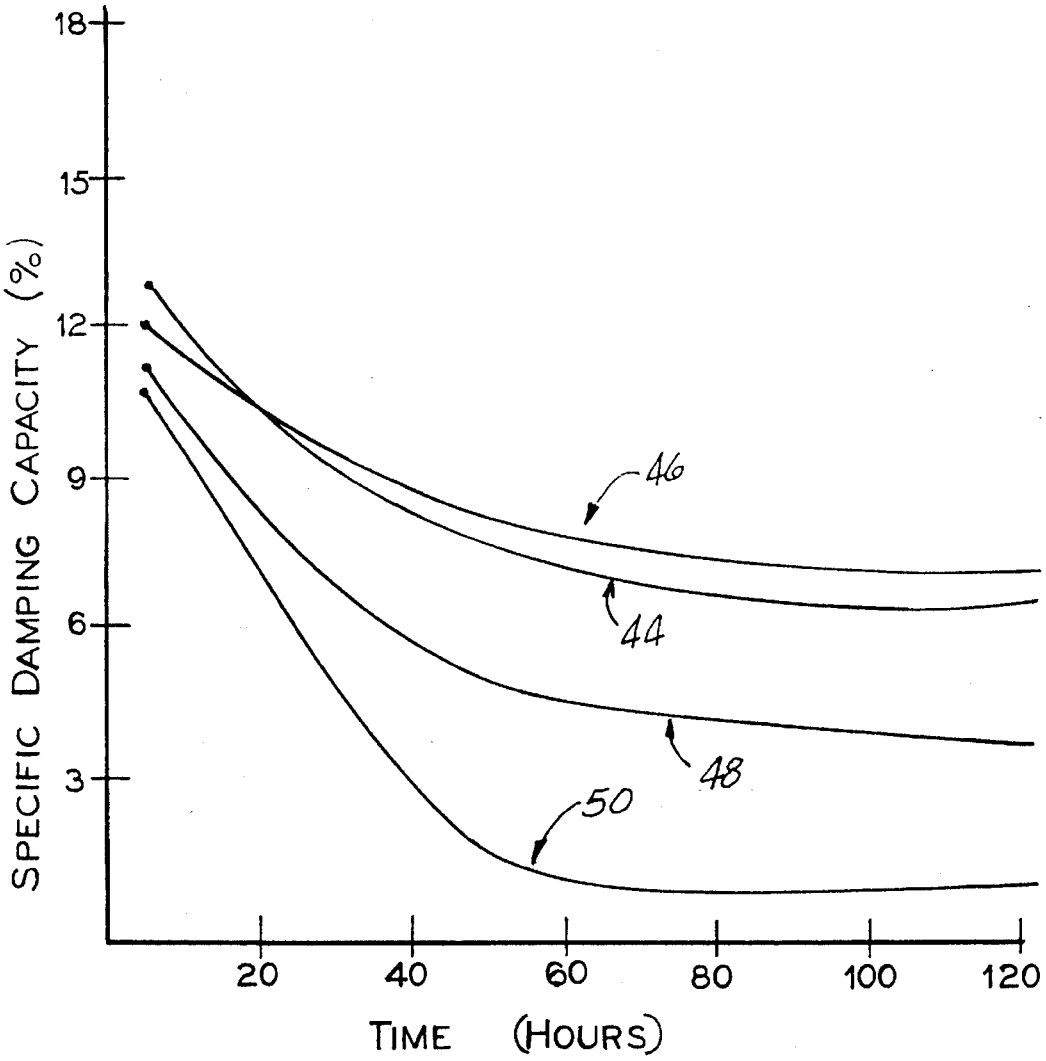
FIG. 4 graphically illustrates the specific damping capacity of spray cast copper-manganese alloys.

As shown in FIG. 4, the initial (following aging) SDC was highest for the mixture of zirconium and erbium (reference line 44). However, for extended periods of time, the highest SDC was achieved when the second addition was zirconium (reference line 46). Lower SDC values were obtained when the second addition was erbium (reference line 48) or no second addition was present (reference line 50).

It is apparent that there has been provided in accordance with this invention a spray cast copper alloy having reduced porosity which fully satisfies the objects, means and advantages set forth herein before. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the claims.

We claim:

1. A copper manganese alloy, having a composition, by weight, of:

from about 10% to about 50% manganese;

from about 0.05% to about 0.50% zirconium; and the balance copper wherein said copper manganese alloy is spray cast with nitrogen as an atomization gas and said copper manganese alloy contains from about 1 ppm to about 20 ppm nitrogen.

2. The spray cast alloy of claim 1 wherein said nitrogen content is from about 5 ppm to about 15 ppm, by weight.

3. The spray cast alloy of claim 1 wherein said zirconium is present in an amount of from about 0.25% to about 0.45%.

4. The spray cast alloy of claim 1 wherein said copper manganese alloy further contains erbium and the combination of zirconium and erbium is present in an amount of from about 0.10% to about 0.60%.

5. The spray cast alloy of claim 4 wherein said manganese is present in an amount of from about 35 to about 45 weight percent.

6. A spray cast alloy having a composition, by weight, of:

copper 52–60%;

manganese 39.0–45.0%;

aluminum 1.0–2.8%;

zirconium 0.05–0.50%;

0.05–0.30% of an addition selected from the group consisting of: chromium, titanium, erbium and mixtures thereof wherein the combination of zirconium and said addition is present in an amount of from about 0.10% to about 0.60%;.

cobalt 0–0.20%;

iron 0–0.20%;

nickel 0–0.20%;

zinc 0–0.20%;

silicon 0–0.10%;

tin 0–0.10%;

carbon 0–0.05%; and phosphorus 0–0.05%.

7. The spray cast alloy of claim 6 wherein said addition is erbium.

8. The spray cast alloy of claim 7 wherein said combination of zirconium and erbium is present in an amount of from about 0.40% to about 0.60%.

9. The spray cast alloy of claim 7 in the form of a tube.

10. The spray cast alloy of claim 7 in the form of an electrical connector.

11. The spray cast alloy of claim 7 in the form of a plate.

12. A sound damping spray cast alloy containing copper and manganese and having a composition, by weight, of 37% Cu, 4% Al, 3% Fe, 1% Ni, 0.05% to 0.50% zirconium, and the balance manganese.

13. The sound damping spray cast alloy of claim 12 further including an addition to inhibit room temperature aging selected from the group consisting of chromium, titanium, erbium and mixtures thereof wherein the combination of zirconium and said addition is present in an amount of from about 0.10% to about 0.60%.

14. The sound damping spray cast alloy of claim 13 wherein said addition is erbium and the combination of zirconium and erbium is present in an amount of from about 0.40% to about 0.60%.

* * * * *